US005224847A

United States Patent [19]

Kurisu

[11] Patent Number: 5,224,847

[45] Date of Patent: Jul. 6, 1993

[54] ROTARY ENGINE

[76] Inventor: Mikio Kurisu, 1117-93 Tsuzu, Iwakuni 740, Japan

[21] Appl. No.: 829,278

[22] Filed: Feb. 3, 1992

[51] Int. Cl.[5] ..... F02B 53/00

[52] U.S. Cl. ..... 418/36; 74/437

[58] Field of Search ..... 123/245; 418/36; 74/435, 437

[56] References Cited

U.S. PATENT DOCUMENTS

| | | | |
|---|---|---|---|
| 2,085,505 | 6/1937 | Murakami . | |
| 2,108,385 | 2/1938 | Murakami . | |
| 2,531,903 | 11/1950 | Berck | 418/36 |
| 3,098,399 | 7/1963 | Berthiaume | 74/437 X |
| 3,798,897 | 3/1974 | Nutku | 418/36 X |
| 3,952,607 | 4/1976 | Ring | 74/435 X |
| 4,028,019 | 6/1977 | Wildhaber | 418/36 |
| 4,174,930 | 11/1979 | Posson | 418/36 |
| 4,901,694 | 2/1990 | Sakita | 418/36 X |

FOREIGN PATENT DOCUMENTS

| | | | |
|---|---|---|---|
| 581688 | 8/1933 | Fed. Rep. of Germany | 418/36 |
| 338974 | 8/1904 | France | 418/36 |
| 557751 | 5/1923 | France | 418/36 |
| 840949 | 1/1939 | France . | |
| 310185 | 12/1989 | Japan | 418/36 |
| 1211458 | 2/1986 | U.S.S.R. | 418/36 |

*Primary Examiner*—Michael Koczo
*Attorney, Agent, or Firm*—Young & Thompson

[57] ABSTRACT

Improved rotary engines and related rotary mechanisms have a pair of interfitted rotor discs with peripheral rotor heads that define a circular series of chambers in a housing. A non-circular gear is secured to the output/control shaft of each rotor, with the non-circular gears meshing with complementary non-circular gears provided on a common power output shaft. The non-circular gears are configured and oriented such that the distance from its output/control shaft at which one of the non-circular gears engages the complementary non-circular gear on the common power output shaft never simultaneously equals the distance from its output/control shaft at which the other non-circular gear engages the corresponding complementary non-circular gear on the common power output shaft.

9 Claims, 4 Drawing Sheets

ROTARY ENGINE

BACKGROUND OF THE INVENTION

1. Field of the Invention

The present invention relates to rotary engines, and more particularly to rotary engines of the so-called "cat and mouse" type, in which the problems attending the output/rotor-driving gearing of conventional such engines have been solved.

2. Description of the Prior Art

The Wankel engine is the principal rotary engine now in commercial use. This engine has a structure in which a substantially equilateral triangular shaped rotor rotates about an eccentric shaft, while maintaining contact with a trachoidal housing, thereby to define a rotary cycle of intake, compression, ignition, power and exhaust. Because the rotor of the Wankel engine rotates about an eccentric shaft, a counterweight is required to eliminate imbalance. Moreover, because the rotor touches the housing at the apexes of its triangular shape, it is impossible to equip the rotor with multiple gas seals.

Due to this difficulty in maintaining the air-tight sealing, and moreover due to the shape of the rotor and housing formed by a unique curved profile, the Wankel engine cannot produce the high compression ratio necessary to cause proper combustion upon receiving jets of diesel fuel. Moreover, the shape of both the rotor and the housing makes the Wankel engine difficult and expense to manufacture.

On the other hand, engines of the so-called "cat and mouse" type have been proposed, but have not found their way into commercial practice. The basic principle of the cat and mouse engine is to provide a pair of cooperating discs or rotors secured to concentric shafts, the rotors having lobes that together define the radial chambers of the engine. The rotors turn in the same direction, but the output/control gearing causes the rotors to be alternately accelerated relative to one another, such that the radial chambers undergo the cycles of intake, compression, ignition, power and exhaust.

Thus, in operation, one rotor of the engine appears to be always trying to "catch" the other, hence the name cat and mouse.

An example of this type of engine is the Murakami engine, described in U.S. Pat. Nos. 2,085,505 and 2,108,385.

In order to transmit the output of the pair of concentric shafts to a common output shaft, as well as to drive the discs in the above-described cat and mouse motion, it is necessary to provide a set of elliptical or other non-circular gears on the concentric shafts, which mesh with complementary gears provided on the common output shaft.

The principal problems preventing conventional cat and mouse engines from being commercially exploited are (1) the gears described above are subject to extreme wear, which limits the useful life of the engine, and (2) it has proven extremely difficult to seal engines of this type effectively, as there is invariably leakage of the exploding fuel-air mixture from the gas seals.

In addition to the prior art described above, there are conventional compressors and pumps that include piston and fan types and those that use root- or vane-shaped rotors; however, all of these compressors and pumps have problems with vibration or rotation speed changes, as well as maintaining air-tightness, because the rotors contact along a line.

SUMMARY OF THE INVENTION

It has now been found that the above-described problems attending conventional cat and mouse engines, namely excessive gear wear and failure of the gas seals, are both attributable to the same source: the non-circular gearing used to (1) transmit the output of the rotor shafts to the common output shaft, and (2) control the cat and mouse alternating relative acceleration of the rotors.

In particular, and as a result of extensive design study by the present inventor, it has been discovered that the above-described problems attending conventional cat and mouse engines can be overcome by configuring the non-circular gears such that the moment force applied to the gear on one rotor shaft never equals the moment force applied to the gear on the other rotor shaft.

As a practical matter, this means that the gears must be so configured that, during operation of the engine, the distance from the first rotor shaft to the point at which the first rotor gear meshes with the corresponding output shaft gear must never simultaneously equal the distance from the second rotor shaft to the point at which the second rotor shaft meshes with its corresponding output shaft gear.

The above provision is based on the recognition that, during the combustion cycle of a cat and mouse rotary engine, the force of the expanding combusted gases seeks to repel the interfitted rotor discs, whereby one rotor is accelerated in the direction of rotation, and the other is decelerated (and indeed, but for its rotational inertia, the other rotor would be driven backwards). If, during this combustion cycle, the moment forces at the points of gear engagement are equal, these forces will equally oppose one another, thereby disrupting the smooth rotation of the engine and causing tremendous instantaneous stress on the gear teeth. The former undesired phenomenon, disruption of smooth rotation, prevents the exploding fuel-air mixture from expanding correctly in the chamber, and it is believed to ultimately result in the failure of the gas seals. The second phenomenon, tremendous instantaneous stress of the gear teeth, rapidly causes the stripping of the gears and the failure of the engine.

OBJECTS OF THE INVENTION

It is accordingly a principal object of the present invention to provide a cat and mouse engine in which the output/control gearing is so configured that the moment forces applied to the gear sets never equal one another during operation of the engine.

It is a further object of the invention to provide a rotary engine in which the gear sets are not subject to the stresses that cause stripping of the gears and failure of the gas seals in conventional rotary engines.

It is a still further object of the invention to provide a rotary engine that needs no counterweight.

A yet further object of the invention is to provide a rotary engine which can easily produce any desired compression ratio, and particularly compression ratios substantially higher than can be achieved using rotary engines now in commercial use.

A yet still further object of the invention is to embody the above construction principles in a variety of innovative rotary engine designs, which are compact and simple in structure, having relatively few parts, and are easy to manufacture.

BRIEF DESCRIPTION OF THE DRAWINGS

The above and other objects and advantages of the invention will be more readily apparent from a reading of the following detailed description, taken with reference to the accompanying drawings, in which.

DETAILED DESCRIPTION OF PREFERRED EMBODIMENTS

Figure 1:
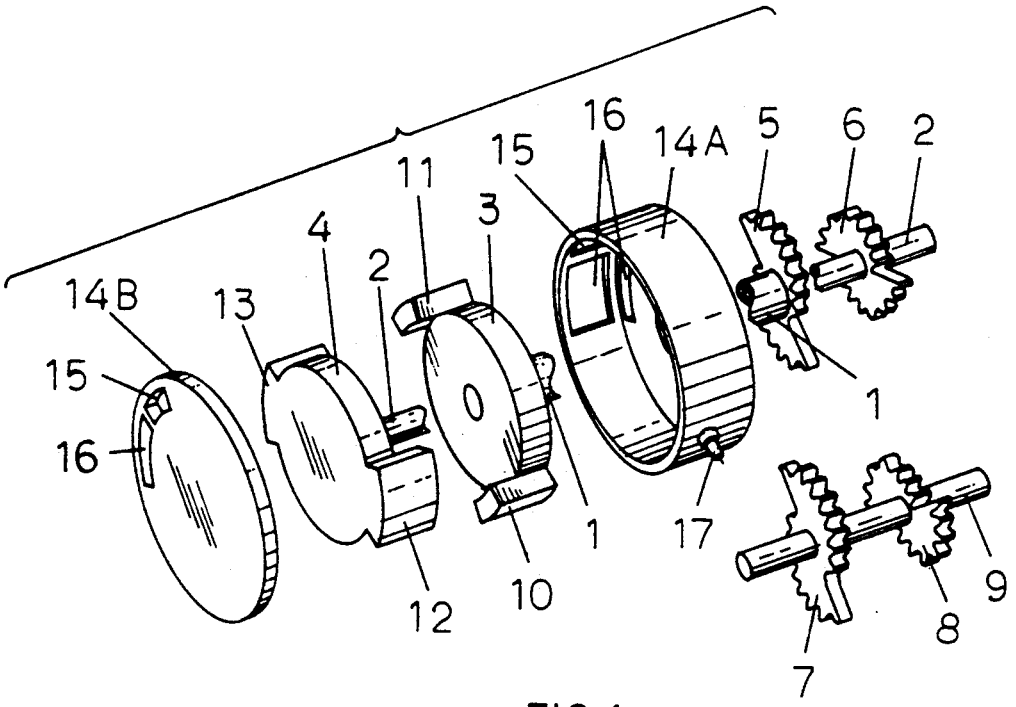
FIG. 1 is an exploded view of a first embodiment of a rotary engine according to the invention.

Referring now to the accompanying drawings, FIG. 1 shows a rotary engine according to a first embodiment of the invention, in which it will be seen that rotor 3 is designed to interfit with rotor 4. In particular, rotor 3 has a central hole and a hollow output shaft 1, the diameter of the central hole and the inner diameter of the output shaft 1 being large enough to receive the output shaft 2 of the other rotor 4. Thus, in the assembled condition, the rotors 3 and 4 are interfitted, with their central disc-shaped portions in face-to-face contact.

Rigidly secured to the output shaft 1 of rotor 3 is a specially-configured gear 5, which, as can be seen in FIG. 1, is composed of a pair of 180° radially offset segments of continuously increasing radius. Similarly, an identical gear 6 is rigidly secured to the output shaft 2, such that the gears 5 and 6 are free to rotate relative to one another in keeping with the motion of the rotors 3 and 4.

The gears 5 and 6 serve to smoothly transmit the rotation of shafts 1 and 2 to a common output shaft 9, via corresponding gears 7 and 8 that are rigidly secured to the shaft 9.

It will be noted that gears 7 and 8 are rigidly secured to the common output shaft 9, and thus do not rotate relative to one another. Moreover, it will be noted that gears 7 and 8 are identical to one another, but are 90° out of phase.

The design of the gear set 5, 6, 7 and 8 shown in FIG. 1 is such that gear 5 is in continuous meshing engagement with gear 7, and likewise gear 6 is in continuous meshing engagement with gear 8; however, at no point during the operation of the engine does the distance from shaft 1 at which gear 5 engages gear 7 equal the distance from shaft 2 at which gear 6 engages gear 8. This is the fundamental design feature common to all of the disclosed embodiments of the invention, but which has apparently eluded the designers of conventional cat and mouse engines as described earlier.

With further reference to FIG. 1, the rotors 3, 4 are relatively thick discs having diametrically opposed rotor heads 10 and 11 (rotor 3) and 12 and 13 (rotor 4). Each rotor head 10–13 has a predetermined circumferential extent, and it will be noted that the axial extent of the rotor heads is substantially greater than that of the central disc portions of the rotors. Indeed, the axial extent of the rotor heads 10–13 is advantageously twice that of the central disc-shaped portions of the rotors 3 and 4, such that the uppermost radial surface of the rotor heads of one rotor will be flush with the lowermost surface of the other rotor, in the assembled condition.

The interfitted rotors 3 and 4 are received in a cylindrical housing 14A, 14B, and the rotor heads 10–13 together with this housing define four air chambers, which are continually increasing and decreasing in volume as the rotors turn.

It will be noted that the face-to-face contact of the rotors relative to one another, as well as the rotors within the housing, means that as many air seals and oil seals as are necessary can be easily provided. Moreover, the rotors, rotor heads, and housing can all be fitted with openings of adequate size and shape for cooling, lubricating, and weight reduction, as desired.

The housing 14A, 14B is also provided with intake ports 15, exhaust ports 16, and a sparkplug or fuel injection nozzle 17. The intake and exhaust ports are disposed circumferentially adjacent one another, whereas the sparkplug or fuel injection nozzle is disposed diametrically opposite the intake port.

It will be recognized that by virtue of the inventive design, it is not necessary to equip the engine with intake valves or exhaust valves.

Figures 2A, 2B, 2C:
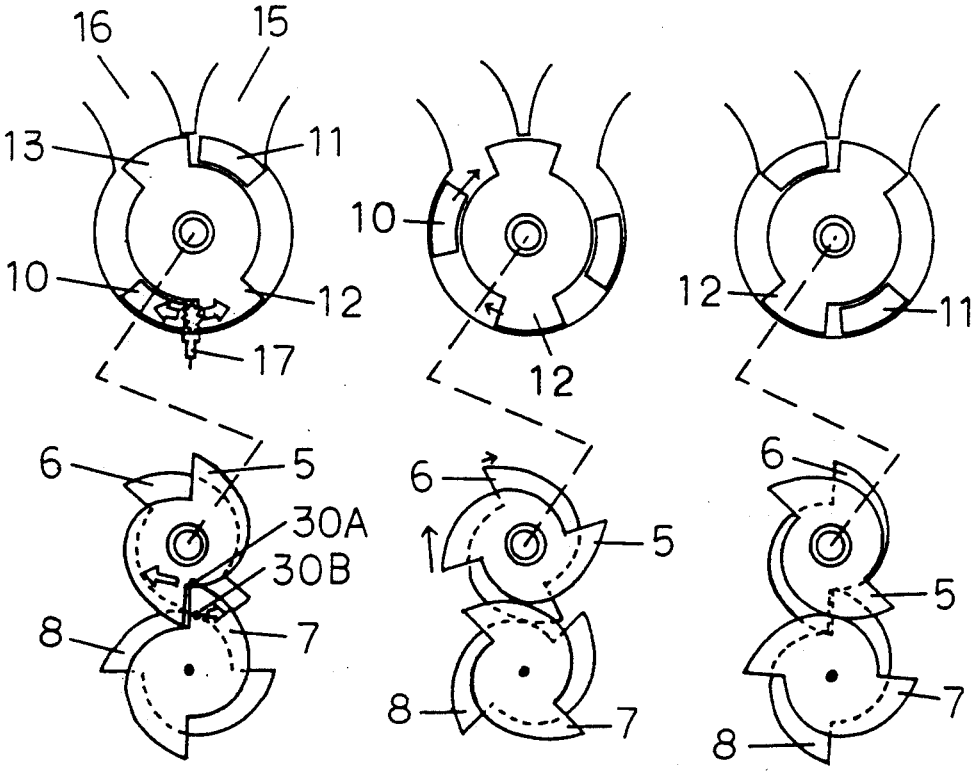
FIGS. 2A, 2B and 2C are schematic diagrams showing the corresponding rotor and gear positions during operation of the engine of FIG. 1.

With reference to FIGS. 2A, 2B and 2C, it will be appreciated that the embodiment of the invention shown in FIG. 1, having four air chambers defined between the rotor heads 10–13, produces four complete operating cycles for each revolution of the rotors 3 and 4.

As shown in FIG. 2A, rotor head 10 of rotor 3 and rotor head 12 of rotor 4 come closest together at the point where sparkplug 17 is located, at the termination of the compression phase. Rotor head 10 in this position is "ahead of" rotor head 12, in the clockwise direction of rotation. At the same time, rotor head 11 of rotor 3 and rotor head 13 of rotor 4 are also drawn close to one another, corresponding to the end of the exhaust phase and the beginning of the intake phase.

At this moment, the shortest radius of gear 5 is meshing with the apex of gear 7, at point of action 30A of FIG. 2A. At the same time, gear 6 is in meshing engagement with gear 8, at point of action 30B. When the sparkplug 17 ignites the compressed fuel-air mixture in the chamber between rotor heads 10 and 12, rotor heads 10 and 12 are forced to move relative to one another because of pressure from the expanding gas. Shafts 1 and 2 thus rotate, as do gears 5 and 6.

However, because the distance from point of action 30A to shaft 1 is shorter than that from point of action 30B at this instant, a stronger moment force is transmitted to point of action 30A, although the same force was applied to both rotor heads 10 and 12.

In other words, the force with which gear 5 pushes gear 7 is greater than the force with which gear 6 pushes gear 8 in the opposite direction. Gears 7 and 8, both being fixed to shaft 9, then rotate in the same direction that gear 5 pushes gear 7. Gear 6, therefore, must also turn in the same direction as gear 5. Since the distance between point of action 30A and shaft 1 is shorter than that of point of action 30B (the radius of gear 5 at this point is smaller), the angular velocity of gear 5 is greater than that of gear 6 at this instant.

Consequently, rotor 3, which is fixed to shaft 1 along with gear 5, rotates at a greater angular velocity than does rotor 4, which is fixed to shaft 2 along with gear 6. Rotor heads 10 and 12 therefore rotate in the same direction, but at a different angular velocity that serves to increase the chamber volume therebetween.

When rotor 10 reaches rotor head 13 (see FIG. 2B), the power stroke is completed.

At the same time that this power stroke is taking place, the chamber volume between rotor heads 11 and 13 is expanding, thereby serving to draw in a fuel-air mixture through the intake ports 15; and also during the power stroke between heads 10 and 12, the chamber volume between heads 11 and 12 is decreasing, thereby serving to compress the fuel-air mixture that was drawn in during the previous phase. The chamber volume between rotor heads 10 and 13 is also decreasing during this time, forcing the exhaust gas out through the exhaust ports 16.

Thus, during operation of the engine depicted in FIGS. 1, 2A, 2B and 2C, each of the strokes making up a four-stroke cycle is occurring simultaneously in a respective one of the four chambers defined by the rotor heads 10–13.

With reference to FIG. 2C, when rotor head makes it closest approach to rotor head 12, the shortest radius of gear 6 meshes with the apex of gear 8, and a point 90° from the apex of gear 7 meshes with gear 5.

Thereafter, the above described operation begins anew, with the roles of rotors 3 and 4 being switched. That is, for the next combustion stroke (between rotor heads 11 and 13), the corresponding gear positions will be as shown in FIG. 2A for the combustion stroke between rotor heads 10 and 12.

As gears 7 and 8 are offset 90°, everything takes place at the same location as in the previous cycle. This requires only one set of intake and exhaust ports, and only one sparkplug.

It will be noted that power can be taken off the above-described engine directly from either of the rotor shafts 1 and 2, in which case the common shaft 9 with gears 7 and 8 would serve solely to control the alternating relative acceleration of the rotors 3 and 4 via gears 5 and 6 and corresponding shafts 1 and 2. However, it is preferred in this embodiment to take the power off of the common output shaft 9, as this shaft 9 has imparted thereto the outputs of both of the rotor shafts 1 and 2.

It should be noted that the compression ratio of the above-described engine can be easily increased by lengthening the circumferential extent of the rotor heads 10–13 to the extent permitted by the shape of the gears, with explosion taking place after intake air is compressed and then injected with fuel.

When the common shaft 9 is used as the output power shaft, the power phase takes place upon each 90° rotation of the drive shaft, resulting in good engine performance.

However, as described below, if further multiples of two rotor heads and gear apexes are added to the engine, then multiple power phases can take place simultaneously at intervals of less than 90° relative to the rotation of the output shaft, resulting in substantial improvements in engine performance.

Needless to say, when the above-described structure is used as a rotary compressor or rotary pump, the rotation of the shaft can be transformed into compressive power by the same principles above, applied in reverse.

It will also be appreciated that, by virtue of the novel gear configuration provided in this and the ensuing embodiments of the invention, not only are the moment forces developed between the two gear pairs always unequal, but also the greater moment force is always applied through that rotor which is "ahead of" the other in the direction of rotation and with reference to the then-occurring power stroke.

Figure 3:
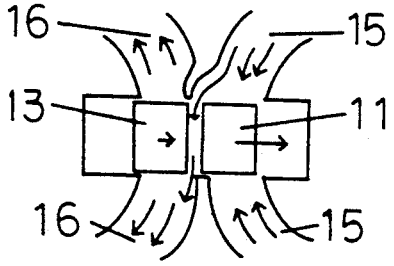
FIG. 3 is an enlarged fragmentary elevational view of a modified intake port and exhaust port according to a second embodiment of the invention.

FIG. 3 shows a modification according to a second embodiment of the invention, in which the intake port 15 of the side housing overlaps the exhaust port 16. In this condition, charged or non-charged fresh air or fuel-air mixture serves to blow away the combustion gases to the exhaust port located on the opposite side housing, at the very end of the exhaust phase. Otherwise, the structure of the second embodiment is the same as the first embodiment described above in connection with FIGS. 1, 2A, 2B and 2C.

Figure 4:
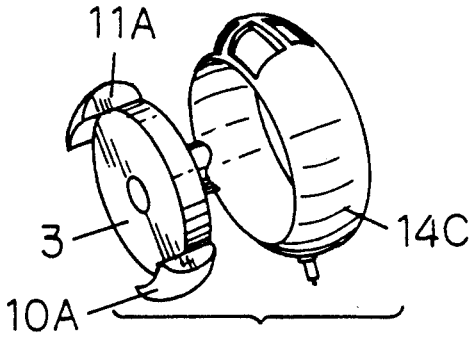
FIG. 4 is an exploded view of a modified rotor and housing according to a third embodiment of the invention.

FIG. 4 shows an engine constructed according to a third embodiment of the invention, in which a modified rotor housing 14C has been given a rounded, toroidal shape, with rotor heads 10A and 11A being given a complementary shape. Rotor 4 is not shown in this embodiment, but would have heads 12A and 13A shaped identically as the heads 10A and 11A. Beyond the rounded shape shown in FIG. 4, the structure of this embodiment is the same as that of FIG. 1.

This embodiment provides the advantage that the air seals and oil seals have fewer right angle surfaces to contend with.

Figure 5:
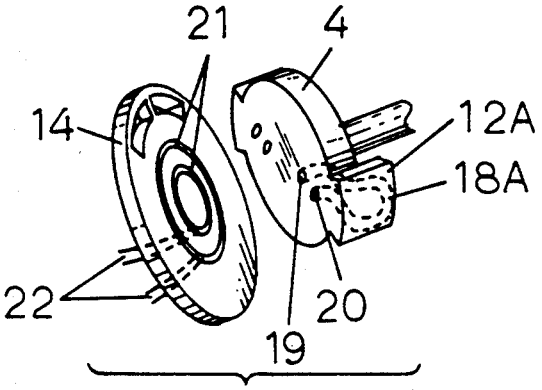
FIG. 5 is a perspective view of a modified side housing and rotor according to a fourth embodiment of the invention, showing provision for a cooling oil or coolant flow.

FIG. 5 shows an engine constructed according to a fourth embodiment of the invention, in which the rotor 4 (and, optionally, the rotor 3) has been provided with cavities 18A that extend into the rotor heads 12A and 13A.

Generally, the structure of this embodiment is the same as that of the embodiment of FIG. 1; however, the cavities 18A communicate with the exterior of the rotor 4 via inject holes 19 and exhaust holes 20, with the inject holes being closer to the shaft 2 than the exhaust holes.

The cavities 18A interconnecting the inject holes 19 and exhaust holes 20 permit circulation of coolant or lubricating oil therebetween. The side housing plate 14 in this embodiment has two concentric circular grooves 21 (located along the loci formed by the rotating inject and exhaust holes) into which fluid flows and from which fluid flows back outside again through tubes 22.

This embodiment permits cooling of the rotors and rotor heads from the inside of the engine.

Figure 6:
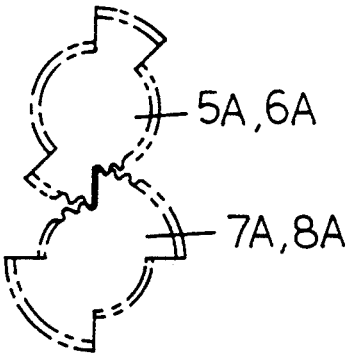
FIG. 6 is a fragmentary elevational view of a gear combination according to a fifth embodiment of the invention.

FIG. 6 shows a fifth embodiment of the invention in which gears 5A, 6A, 7A and 8A are shaped differently than the corresponding gears 5–8 in the embodiment of FIG. 1. In this embodiment, each of the gears has a pair of diametrically opposed segments of larger radius, the remainder of the peripheral surfaces being of smaller radius. It should be noted that in this embodiment all surfaces shown in phantom line in FIG. 6 are occupied by gear teeth, such that the gears 5A and 6A are in continuous meshing engagement with the gears 7A and 8A, respectively.

The main requirement of this embodiment is that the central angle of the larger radius gear sectors of gears 5A and 6A should be the same as the central angle of the rotor heads. As in the previous embodiments, the gears 7A and 8A are offset 90° on the common output shaft 9.

This embodiment differs from those previously described in that each of the gear segments is of constant radius, i.e., a circular arc.

Figure 7:
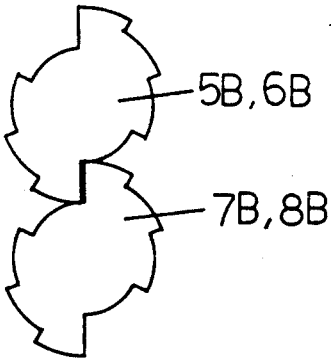
FIG. 7 is a schematic view of a gear combination according to a sixth embodiment of the invention.

FIG. 7 shows a gear set constructed according to a sixth embodiment of the invention, wherein gears 5B, 6B, 7B and 8B comprise stepped segments of decreasing radius. Within each of the stepped segments, the radius may be constant or decreasing. It will be noted that the peripheral surfaces of the gears shows in FIG. 7 are toothed, to provide continuous meshing engagement as in all of the described embodiments.

The radius and central angle of each step can be arbitrarily selected, provided that the length of the periphery of the meshing steps is the same, and the distance between the two shafts remains fixed. It will be appreciated that this embodiment, as well as the embodiment of FIG. 6, ensure that an unequal moment force is always applied to the gear pairs.

Figure 8:
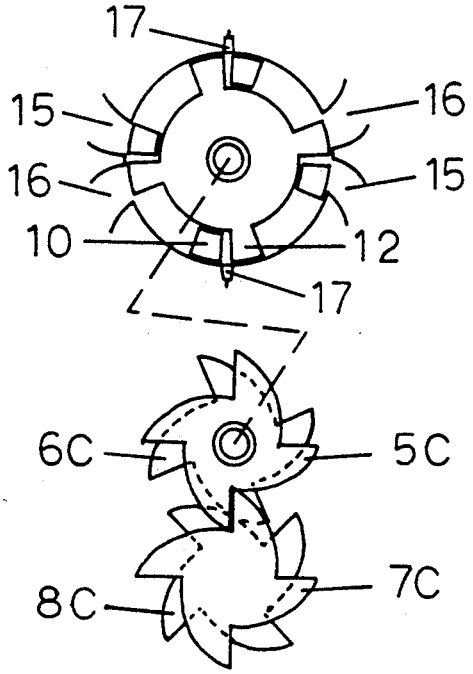
FIG. 8 is a schematic view of the rotor and gear configuration according to a seventh embodiment of the invention.

FIG. 8 shows a seventh embodiment according to the invention, in which the gears 5C, 6C, 7C and 8C have apexes every 90 degrees, and the rotors have rotor heads every 90 degrees.

Correspondingly, the housing comprises two sets of intake ports, two sets of exhaust ports, and two sparkplugs, one set of each of these components being provided every 180°. Gears 7C and 8C are rigidly secured to shaft 9, such that their apexes are staggered by 45°.

In this embodiment, dual four-cycle repetitions occur on both sides of the housing diameter.

With shaft 9 as the output power shaft, a power cycle occurs once every 45° of rotation, resulting in substantial improvements in engine performance.

Figure 9:
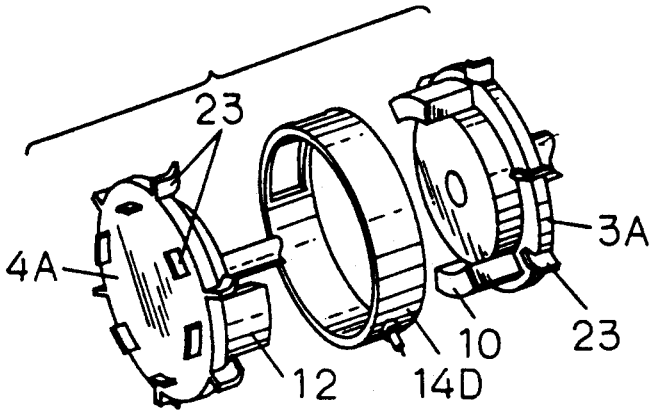
FIG. 9 is an exploded view of a rotor and housing combination according to an eighth embodiment of the invention.

FIG. 9 shows an engine constructed according to an eighth embodiment of the invention, wherein the side housings of the FIG. 1 embodiment are integrated with the rotors 10–13, thereby exposing the rotors 3A, 4A to the atmosphere. Cooling fins 23 are attached to this part of the rotor.

As the rotor turns, it is air-cooled by the rotating cooling fins. In this embodiment, an additional set of cooling fins are attached to the exposed part of the rotor, to blow cool air across the housing 14D, so that the rotors and housing are cooled at the same time.

Figure 10:
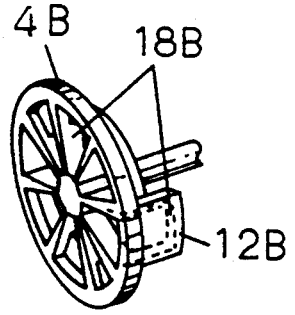
FIG. 10 is a perspective view of a rotor according to a ninth embodiment of the invention.

FIG. 10 shows a rotor constructed according to a ninth embodiment of the invention, wherein the rotor 4B is formed with integral radially extending fins defining cavities 18B. During rotation of the rotor, these fins serve to cool the rotor, while the presence of cavities 18B substantially reduces the weight of the rotors.

Figure 11:
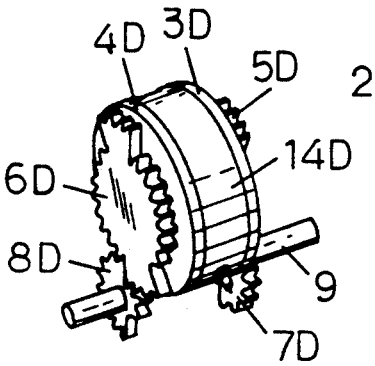
FIG. 11 is a perspective view of a rotor-gear assembly according to a tenth embodiment of the invention.

FIG. 11 shows a motor constructed according to a tenth embodiment of the invention. In this embodiment, gears 5D and 6D are configured as gears 5A and 6A of the embodiment of FIG. 6, but are directly secured to the rotors 3D and 4D, which rotors are in turn configured as the rotors 3A and 4A of the embodiment of FIG. 9. Gears 7D and 8D are secured to the common output shaft 9; however, gears 7D and 8D in this embodiment have only half as many apexes and teeth as do gears 5D and 6D. Thus, the system does not increase in size. In addition, the number of parts in the manufacturing process are simplified because shafts 1 and 2 are not necessary.

This system is also sturdier than those previously described, because the power is conveyed directly from the rotors to the gears without having to be transmitted through shafts 1 and 2.

Figure 12:
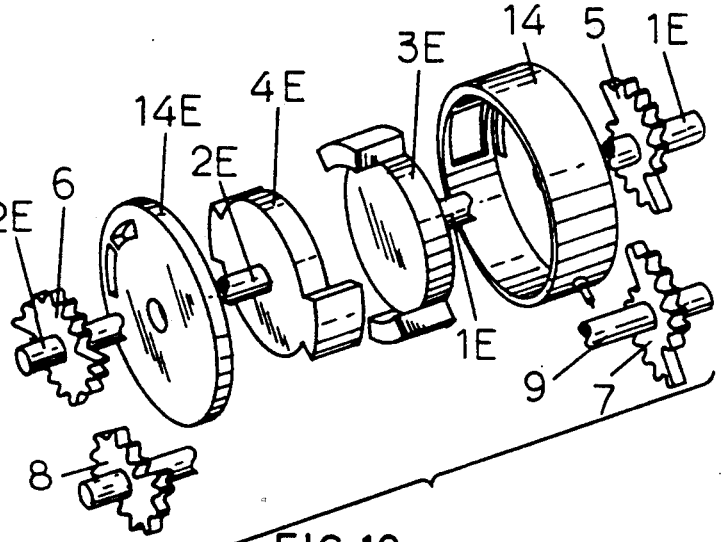
FIG. 12 is an exploded view of a rotary engine according to an eleventh embodiment of the invention.

FIG. 12 is an exploded view of an engine constructed in accordance with an eleventh embodiment of the invention, wherein shaft 2E of rotor 4E passes through a hole in the side housing 14E on the opposite side of housing 14 through which passes the shaft 1E of rotor 3E. Thus, shafts 1E and 2E are not concentric as in the previous embodiments, but remain coaxial.

Gears 5 and 6 are secured to their respective shafts 1E and 2E as in the previous embodiments, and gears 7 and 8 are rigidly secured to the common output shaft 9 as in the previous embodiment, with a 90° offset. However, the spacing between gears 7 and 8 on shaft 9 is greater in this embodiment, because the gears are disposed on opposite sides of the assembled rotor housing.

The remaining structure is the same as in the first embodiment of the invention. This embodiment of the invention will also be somewhat sturdier in that neither of the rotors shafts need be hollow, nor do either of the rotors require a central hole for accommodating the shaft of the other rotor.

It will be noted that the sparkplug of this embodiment has been replaced by a fuel injection nozzle, so that the engine of this embodiment will function by injecting fuel in the manner of a diesel engine.

Figure 13:
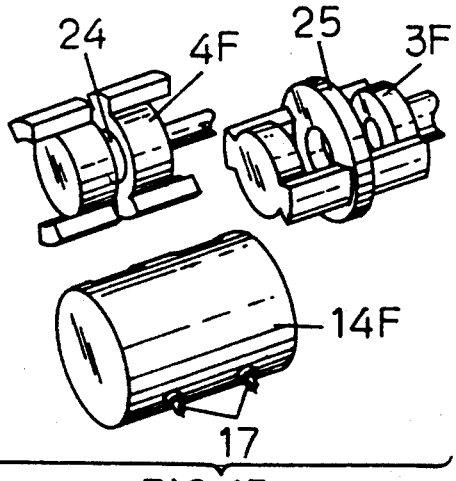
FIG. 13 is a perspective view of the various components of a rotary engine according to a twelfth embodiment of the invention.

FIG. 13 shows another inventive application of the principles herein described, wherein a twelfth embodiment of the invention comprises two sets of rotary engines joined together by rotors coupled without shafts and enclosed in a housing.

Specifically, the rotors 4F disposed next to each other in axial relation are interconnected by a small connecting disc 24, whereas the rotors 3F positioned axially adjacent one another are connected with a larger partitioning disc 25.

These components are enclosed within a large cylinder-shaped housing 14F, which has two side plates. A hole in the large partitioning disc 25 allows the small connecting disc 24 to pass therethrough.

The rotors 4F interconnected by the small connecting disc 24 are thicker than the other pair of rotors 3F, in order to balance the inertial mass constituted by the respective rotor structures.

In this embodiment, two sets of intake ports, exhaust ports and sparkplugs are positioned on the rotor housing, in locations that will be evident from the foregoing description of the preceding embodiments.

This embodiment is advantageous in that the engine as a whole is kept very compact and sturdy by connecting rotors without shafts or gears, when multiple units are added in succession.

Needless to say, the set of rotors 4F has an output shaft corresponding to shaft 2 of FIG. 1, whereas the set of rotors 3F has an output shaft corresponding to shaft 1 of FIG. 1, such that the shaft of rotor 4F passes through the shaft of rotor 3F, with these shafts being in turn connected to a gear set and common output shaft 9 as shown in FIG. 1.

It also goes without saying that the embodiment of FIG. 13 could not be assembled from the components as shown for purposes of explanation in that figure; instead, the rotors 4F can be secured to one another only after the small connecting disc 24 is received within the central hole of the larger partitioning disc 25, with the rotors 3F being then secured to the partitioning disc 25 to complete the inner engine structure.

Figure 14:
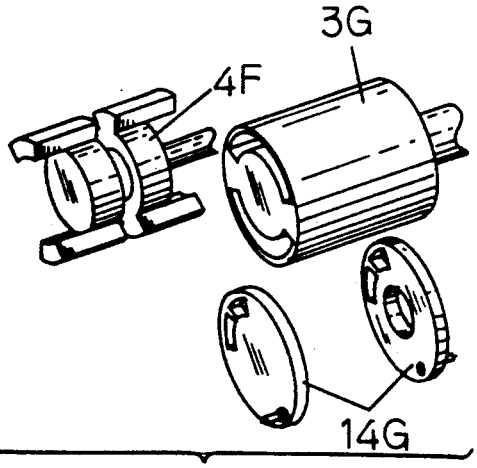
FIG. 14 is a perspective view of the various components of a rotary engine according to a thirteenth embodiment of the invention.

FIG. 14 shows a further modification of the embodiment of FIG. 13, wherein in this thirteenth embodiment according to the invention the rotor assembly 3F, 25 of FIG. 13 has been formed integrally with the housing 14F to form a new housing 3G. Each side housing plate 14G accordingly has the necessary intake ports, exhaust ports and sparkplugs.

In this embodiment, power is advantageously produced directly solely from the shaft connected to the rotor 3G, due to this rotor's greater mass of inertia.

It will be evident that to assembly the embodiment depicted in FIG. 14, the rotor 3G and the rotor assembly 4F will each need to be formed in two pieces, to permit assembly in a manner similar to that described for the embodiment of FIG. 13.

As the integral rotor/housing 3G of the FIG. 14 embodiment will rotate as a whole, it will obviously have to be received within suitable bearings at its location of use.

Figure 15:
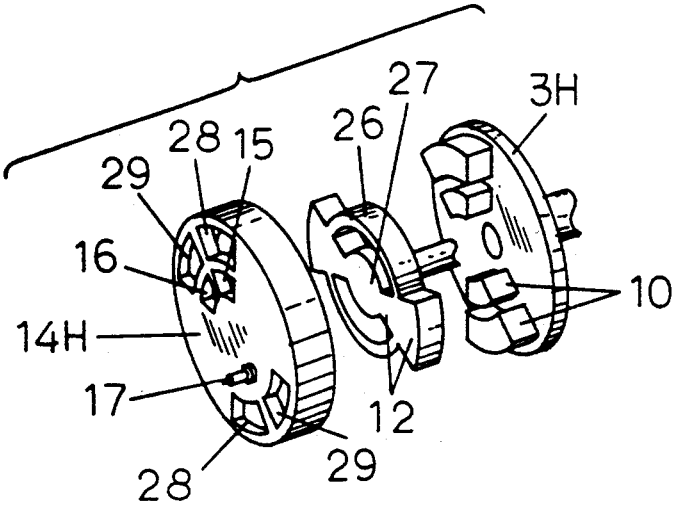
FIG. 15 is an exploded view of a rotary engine according to a fourteenth embodiment of the invention.

FIGS. 13 and 14 show embodiments of the invention wherein a twin motor structure is created by disposing two sets of rotors side by side in axial relation. By contrast, FIG. 15 shows a motor constructed according to a fourteenth embodiment of the invention, in which a twin motor structure has been constructed by disposing dual rotor sets in side-by-side radial relation.

In particular, one rotor 3H is a large disc containing two sets of diametrically opposed rotor heads describing two concentric circles, all of the rotors having the same central angle. A second rotor consists of two sets of rotor heads positioned in size like those of the rotor 3H, but with the rotor heads formed integrally with a positioning ring 26 and a smaller central disc 27.

These two rotor components are interfitted and enclosed in a housing 14H having a disc-shaped wall defining one side of the housing, and an annular wall enclosing the cylindrical periphery of the housing. The opposite wall of the housing is formed by the disc-shaped portion of rotor 3H.

In this embodiment, the outer four chambers are used as two sets of pumps because the outer area is larger, and the inner chambers are used as a rotary engine, complete with an intake, compression, power and exhaust cycle. Accordingly, the outer chamber has two sets of intake ports 28 and exhaust ports 29, one every 180°, and contains no sparkplug. On the other hand, the inner chamber, intake port 15, exhaust port 16 and sparkplug 17 are located radially inwardly of housing 14H.

By virtue of this embodiment, pumps having an integrated motor can be readily manufactured.

Figure 16:
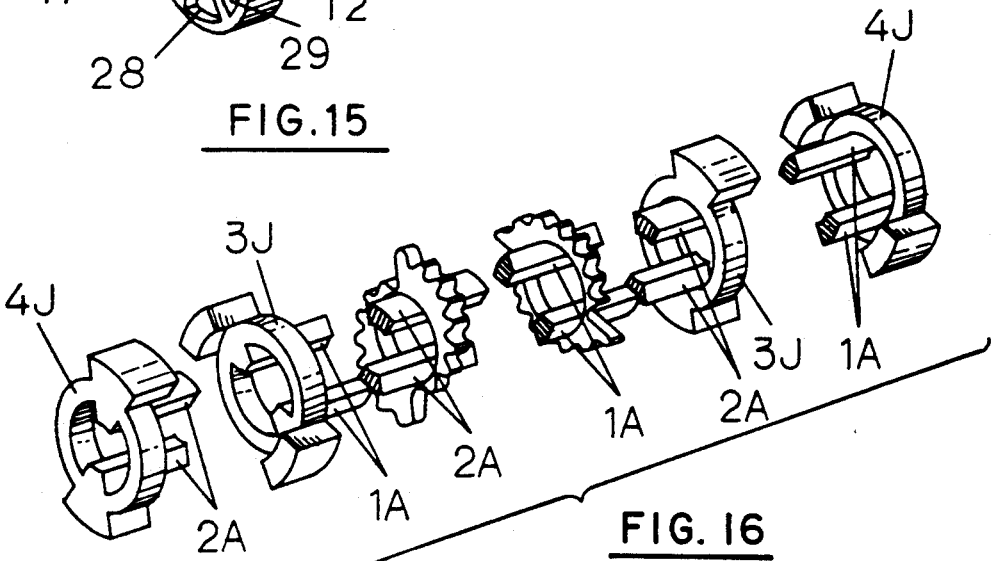
FIG. 16 is an exploded view of a rotary engine according to a fifteenth embodiment of the invention.

FIG. 16 shows an engine constructed in accordance with a fifteenth embodiment of the invention, wherein two sets of coupled rotary mechanisms coact with two sets of shafts 1A, 2A.

In this embodiment, it has been found that, by replacing the concentric coaxial shafts 1 and 2 of the first embodiment with pairs of diametrically opposed eccentric split shafts 1A and 2A, two complete rotary mechanisms can be coupled to opposite ends of the same shaft set, with the gear set being disposed intermediate the two rotary mechanisms.

In particular, FIG. 16 shows a pair of diametrically opposed shafts 1A onto which are rigidly secured rotor 3J, gear 5 and rotor 4J. Similarly, onto two diametrically opposed shafts 2A are rigidly secured rotor 3J', gear 6 and rotor 4J'.

It will be noted that the split shafts of this embodiment are not cylindrical; quite the contrary, each shaft is arcuate in cross section, extending over approximately 45° of arc, such that the composite shaft set has the minimum influence on the inertial mass of the functioning engine.

It will be noted that the center of each gear and each rotor 3J, 3J' comprises an opening of sufficient diameter that the shafts 1A, 2A can oscillate therewithin.

In this embodiment, one of the rotary mechanisms is used as a compressor with two sets of intake ports and exhaust ports every 180° on the housing. The other rotary mechanism is used as a rotary engine, wherein its position on the opposite side of the gear set minimizes the effect of the heat generated from the engine on the compressor.

This embodiment has advantages in that (1) the compressor is spaced apart from the prime mover, so that the air for the compressor is not heated unnecessarily, and (2) the use of split shafts avoids the complexity of additional gears and shafts that are necessary when using ordinary concentric shafts.

As the shafts 1A, 2A of this embodiment are eccentric, the distances to be considered when providing the unequal moment forces is the distance from the axis of rotation of the rotors, rather than the distance from the shafts themselves.

Figure 17:
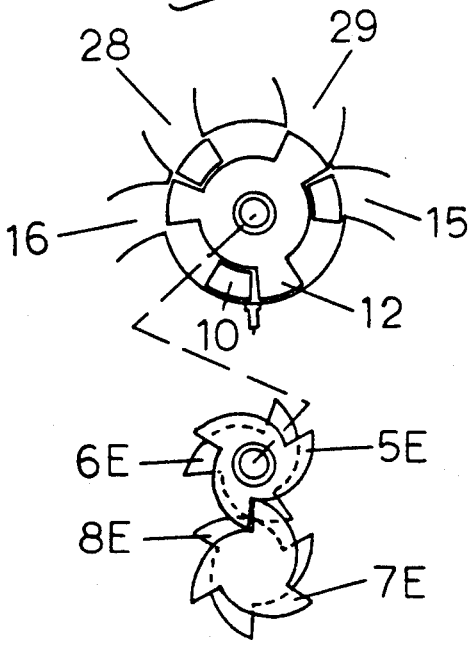
FIG. 17 is a schematic diagram showing the rotor and gear structure according to a sixteenth embodiment of the invention.

FIG. 17 shows an engine constructed according to a sixteenth embodiment of the invention, wherein each of the rotors has three rotor heads. In keeping with this rotor design, gears 5E, 6E, 7E and 8E each have three apexes, the apexes occurring every 120° over the periphery of the gear surface.

As in the previous embodiments, the gears 7E and 8E are rigidly secured to the common power output shaft 9, and it will by now be evident that the apexes of gears 7E and 8E are offset relative to one another by 60° in the direction of rotation.

The interfitted three-head rotors together define six chambers. Of these six chambers, four are used for the four cycles of intake, compression, power and exhaust, and the remaining two are for intake and exhaust only.

These last two strokes can be used for compression, but in this instance are idle strokes, letting air in and out. Eventually, this air admitted and expelled during the idle strokes will serve to cool down the rotor heads.

This embodiment has advantages in that six power strokes per power shaft revolution are obtained when shaft 9 is the common output power shaft. At the same time, the rotor heads can be air-cooled while maintaining continuous power output.

Figure 18:
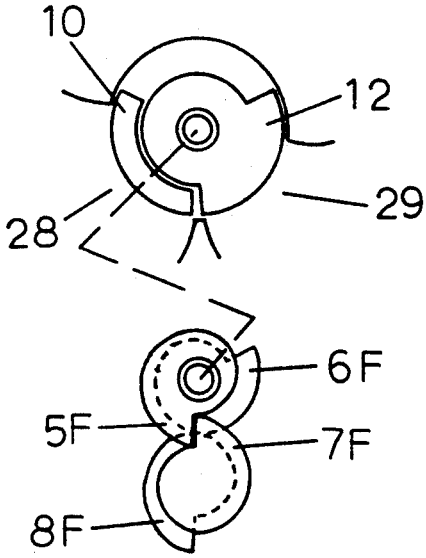
FIG. 18 is a schematic diagram of the rotor and gear structure according to a seventeenth embodiment of the invention.

FIG. 18 depicts a rotary mechanism constructed in accordance with a seventeenth embodiment of the invention, in which the rotors each comprise only one rotor head. In this embodiment, the rotary mechanism is used as a compressor which receives power from the outside. Rotors and gears 5F, 6F, 7F and 8F have only one rotor head and one apex, respectively, and are enclosed in a housing having an intake port 28 and an exhaust port 29.

From the foregoing description of various preferred embodiments according to the invention, it will be evident to those skilled in the art that the rotary engines and related rotary mechanisms according to the invention bring forward the following advantages:

1. The principal moving components are only two rotors and four gears, which are all of similar shape;

2. All of the moving components have shapes that are balanced both statically and dynamically, and are secured to centered shafts and rotate about the shafts, thereby requiring no counterweights;

3. The housing can be a simple cylindrical shape, because the locus of the rotary heads during operation is circular;

4. Only one set of intake and exhaust ports and one sparkplug or fuel injection nozzle is required because each phase of intake, compression, power and exhaust takes place at the same location;

5. Intake valves and exhaust valves are not necessary, and intake and exhaust ports can be made as wide openings leading to lower air resistance;

6. Advantages 1, 3 and 5 noted above result in simplified manufacture of the components;

7. The two sets of gears are always subject to a difference in the moment force applied to the gears, whereby the combustion power is transformed into rotation very smoothly, without creating excessive stress on the rotor heads and gears;

8. The rotors, rotor heads and housings contact each other face-to-face, so as many seals as are needed can be easily provided;

9. The power phase takes place at least every 90° of rotation of the power output shaft, resulting in good engine performance; and 10. Many variations and combinations can be provided. In particular, if multiples of two rotor heads and gear apexes are added to the engine, multiple power phases can take place at intervals of less than 90° of rotation of the power output shafts. Moreover, if multiple sets of rotors and rotor heads are coupled by partitions, multiple units can be provided in succession without shafts, and can be enclosed in a housing making the overall assembly very compact and sturdy.

Although the present invention has been described in connection with various preferred embodiments thereof, it will be appreciated that these have been provided for purposes of illustration only, and should in no way be construed as limiting the true scope and spirit of the invention as set forth in the appended claims.

What is claimed is:

1. A rotary engine, comprising a pair of interfitted rotors supported in a housing for rotation about a common axis and relative to one another, said rotors having cooperating peripheral rotor heads defining with said housing a circular series of chambers, each of said rotors having an output/control shaft carrying a first non-circular gear; and a common shaft having a pair of second non-circular gears secured thereto, each of the first non-circular gears being in continuous meshing engagement with a respective one of said second non-circular gears; said first and second non-circular gears comprising radially-offset segments of continuously decreasing radius, and said second non-circular gears being so oriented on said common shaft, that the distance from its output/control shaft at which one of said first non-circular gears engages one of said second non-circular gears never simultaneously equals the distance from its output/control shaft at which the other of said first non-circular gears engages the other of said second non-circular gears; said housing having intake ports and exhaust ports communicating with said chambers, and at least one opening for receiving a sparkplug or fuel injection nozzle.

2. The engine according to claim 1, wherein said output/control shafts are concentric and extend in the same direction from said housing, one of said output/control shafts being hollow and the other of said output/control shafts being rotatably received in said hollow shaft.

3. The engine according to claim 1, wherein said output/control shafts are coaxial and extend in opposite directions from said housing.

4. The engine according to claim 1, wherein said rotors comprise internal conduits for circulation of cooling fluid.

5. The engine according to claim 1, wherein said housing and said rotors have a toroidal shape.

6. A rotary engine, comprising a pair of interfitted rotors supported in a housing for rotation about a common axis and relative to one another, said rotors having cooperating peripheral rotor heads defining with said housing a circular series of chambers, each of said rotors having a first non-circular gear formed integrally therewith; and a common shaft having a pair of second non-circular gears secured thereto , each of the first non-circular gears being in continuous meshing engagement with a respective one of said second non-circular gears; said first and second non-circular gears comprising radially-offset segments of continuously decreasing radius, and said second non-circular gears being so oriented on said common shaft, that the distance from said common axis at which one of said first non-circular gears engages one of said second non-circular gears never simultaneously equals the distance from said common axis at which the other of said first non-circular gears engages the other of said second non-circular gears; said housing having intake ports and exhaust ports communicating with said chambers.

7. A rotary engine, comprising a pair of interfitted rotors supported in a housing for rotation about a common axis and relative to one another, said rotors having cooperating peripheral rotor heads defining with said housing a circular series of chambers, each of said rotors having an output/control shaft carrying a first non-circular gear; and a common shaft having a pair of second non-circular gears secured thereto, each of the first non-circular gears being in continuous meshing engagement with a respective one of said second non-circular gears; each of said rotors having two rotor heads; each of said first and second non-circular gears comprising two radially-offset segments of continuously decreasing radius, and said second non-circular gears being so oriented on said common shaft, that the distance from its output/control shaft at which one of said first non-circular gears engages one of said second non-circular gears never simultaneously equals the distance from its output/control shaft at which the other of said first non-circular gears engages the other of said second non-circular gears; said housing having intake ports and exhaust ports communicating with said chambers, and at least one opening for receiving a sparkplug or fuel injection nozzle.

8. A rotary engine, comprising a pair of interfitted rotors supported in a housing for rotation about a common axis and relative to one another, said rotors having cooperating peripheral rotor heads defining with said housing a circular series of chambers, each of said rotors having an output/control shaft carrying a first non-circular gear; and a common shaft having a pair of second non-circular gears secured thereto, each of the first non-circular gears being in continuous meshing engagement with a respective one of said second non-circular gears; each of said rotors having three rotor heads; each of said non-circular gears comprising three radially-offset segments of continuously decreasing radius, and said second non-circular gears being so oriented on said common shaft, that the distance from its output/control shaft at which one of said first non-circular gears engages one of said second non-circular gears never simultaneously equals the distance from its output/control shaft at which the other of said first non-circular gears engages the other of said second non-circular gears; said housing having intake ports and exhaust ports communicating with said chambers, and at least one opening for receiving a sparkplug or fuel injection nozzle.

9. A rotary engine, comprising a pair of interfitted rotors supported in a housing for rotation about a common axis and relative to one another, said rotors having cooperating peripheral rotor heads defining with said housing a circular series of chambers, each of said rotors having an output/control shaft carrying a first non-circular gear; and a common shaft having a pair of second non-circular gears secured thereto, each of the first non-circular gears being in continuous meshing engagement with a respective one of said second non-circular gears; each of said rotors having four rotor heads; each of said non-circular gears comprising four radially-offset segments of continuously decreasing radius, and said second non-circular gears being so oriented on said common shaft, that the distance from its output/control shaft at which one of said first non-circular gears engages one of said second non-circular gears never simultaneously equals the distance from its output/control shaft at which the other of said first non-circular gears engages the other of said second non-circular gears; said housing having intake ports and exhaust ports communicating with said chambers, and at least one opening for receiving a sparkplug or fuel injection nozzle.

* * * * *